US006076722A

United States Patent [19]

Huang

[11] Patent Number: 6,076,722

[45] Date of Patent: Jun. 20, 2000

[54] SECURE DEVICE FOR PIVOTALLY SECURING A TOP COVER ON A POWER STAPLER

[75] Inventor: Chen-Fa Huang, Ta Li, Taiwan

[73] Assignee: Besco Pneumatic Corp., Taichung Hsien, Taiwan

[21] Appl. No.: 09/456,943

[22] Filed: Dec. 7, 1999

[51] Int. Cl.[7] ..... B25C 1/04

[52] U.S. Cl. ..... 227/123; 227/127

[58] Field of Search ..... 227/123, 120, 227/127, 130

[56] References Cited

U.S. PATENT DOCUMENTS

| | | | |
|---|---|---|---|
| 4,436,236 | 3/1984 | Jobe | 227/123 |
| 4,467,952 | 8/1984 | Morrell, Jr. | 227/123 |
| 4,549,681 | 10/1985 | Yamamoto et al. | 227/123 |
| 4,641,772 | 2/1987 | Skuthan | 227/123 |
| 4,688,710 | 8/1987 | Massari, Jr. et al. | 227/123 |
| 5,642,849 | 7/1997 | Chen | 227/127 |

*Primary Examiner*—Scott A. Smith
*Attorney, Agent, or Firm*—Rosenberg, Klein & Lee

[57] ABSTRACT

A secure device for a power stapler includes a top cover on a front end board of the power stapler and a pivotal member pivotally connected to the top cover. A locking frame is engaged with two hooks on the front end board and two plates are overlapped to two side arms of the locking frame. Two springs are respectively mounted to the overlapped side arm and the plate. The two plates are connected to the pivotal member. The springs assists a convenient operation of the pivotal member whenever the pivotal member is lifted upward or pushed downward.

5 Claims, 5 Drawing Sheets

SECURE DEVICE FOR PIVOTALLY SECURING A TOP COVER ON A POWER STAPLER

FIELD OF THE INVENTION

The present invention relates to a secure device to pivotally securing a top cover on a power stapler. The device employs a spring means connected between the locking frame and the lever so that the secure device is easily to be operated.

BACKGROUND OF THE INVENTION

A conventional power stapler generally includes a secure device which secures a top cover on the power stapler so that when the staples in the front end of the power stapler is jammed or the position of the staples is adjusted, the user may disconnects the top cover from the body of the power stapler so as to reach the staples directly. Generally, the secure device is a pivotal mechanism which is performs as a cam so that when the secure device is pushed toward the body of the power stapler, the top cover is secured, and when the secure device is pulled away from the body of the power stapler, the top cover is released. The conventional secure device is generally designed to be tightened so that the user has to take a great effort to lift a lever of the device. Besides, the structure is complicated and includes a lots of parts which increase the total weight of the power stapler and manufacturing cost.

The present invention intends to provide a secure device for a power stapler, wherein a spring means is connected between the locking frame and a lever of the secure device so that no matter the user wants to pull the lever away from the power stapler or to push the lever toward the power stapler, it is easy and convenient.

SUMMARY OF THE INVENTION

In accordance with one aspect of the present invention, there is provided a secure device for securing a top cover on a power stapler. The device includes a top cover located on a top of a front end board on the stapler and two lugs extend from tow sides of the front end board. The top cover is located between two hooks extending from the top end board. A locking frame has a locking rod and two side arms extend from two ends of the locking frame. The locking rod is disengagably engaged with the two hooks and two plates are respectively overlapped to the two side arms. Two springs are respectively mounted to the arm and the plate overlapped with each other.

A pivotal member has two sidewalls and each sidewall respectively connected the two lugs on the top cover and the two plates.

The object of the present invention is to provide a secure device that is easily operated to open the top cover from the power stapler.

Another object of the present invention is to provide a secure device that employs springs mounted to the connection between the pivotal member and the locking frame. The springs provide proper flexibility of convenience for the user to lift or push the pivotal member.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
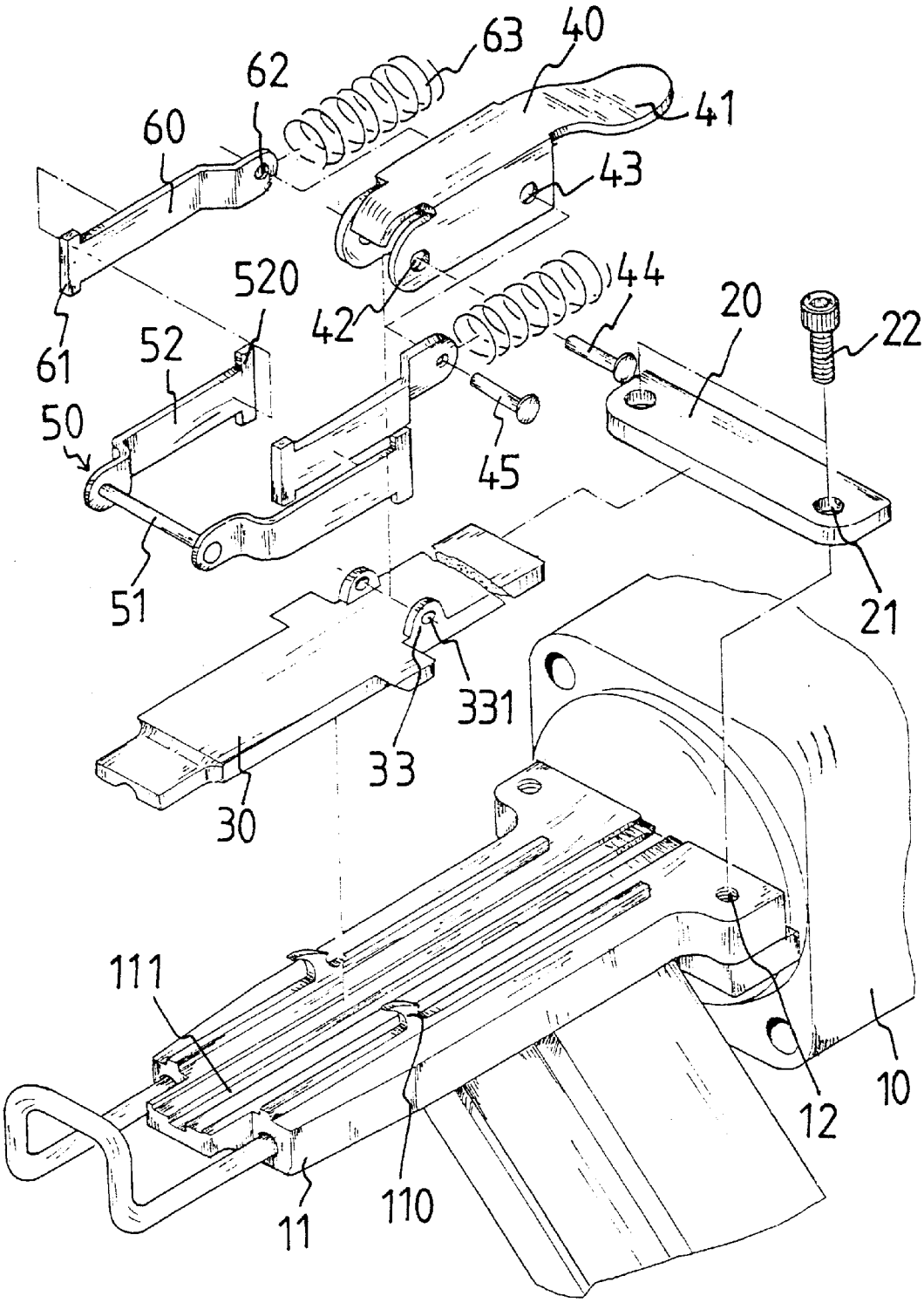
FIG. 1 is an exploded view to show the secure device for securing a top cover on a power stapler of the present invention.
Figure 2:
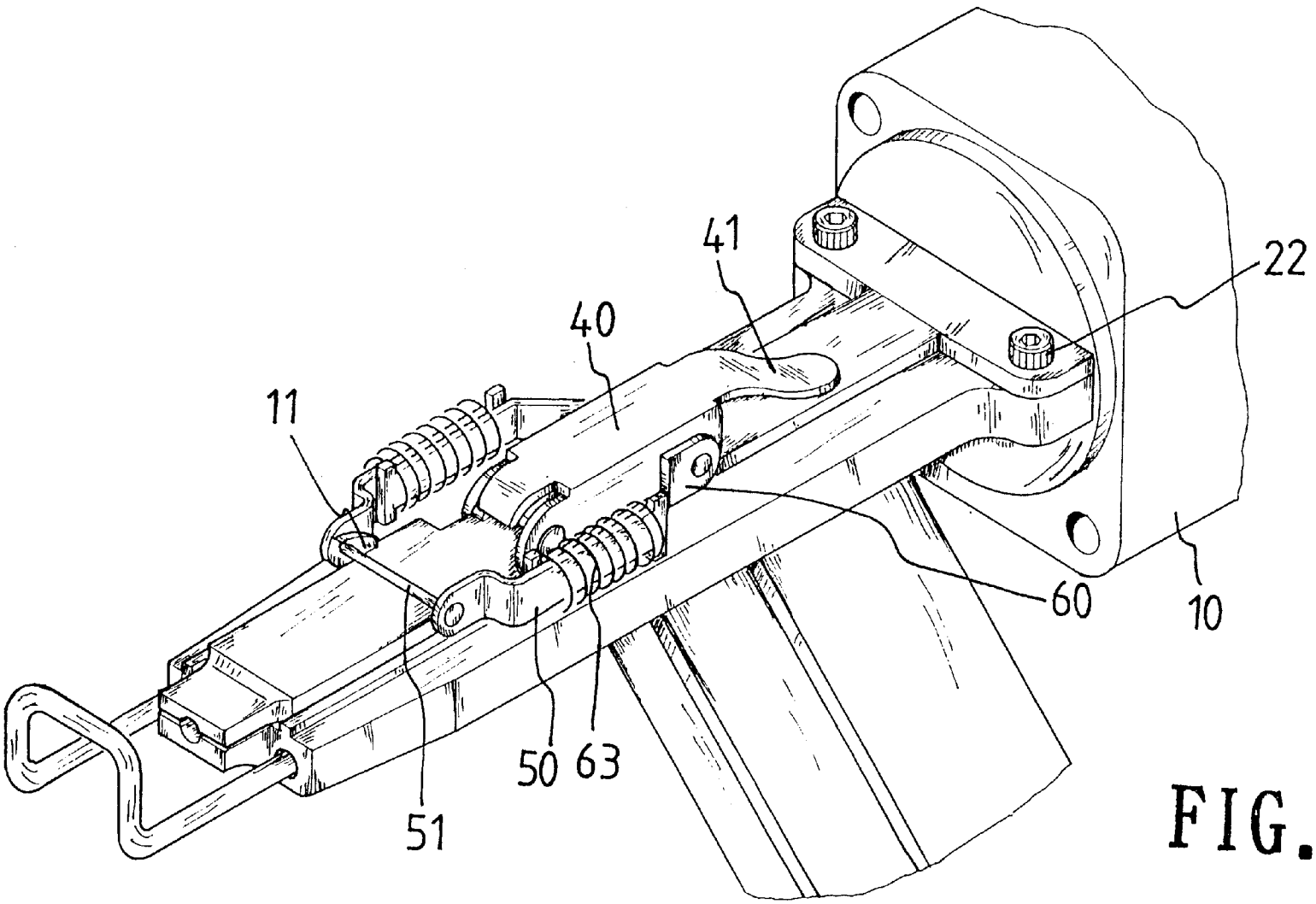
FIG. 2 is a perspective view to show the secure device on the power stapler of the present invention.
Figure 3:
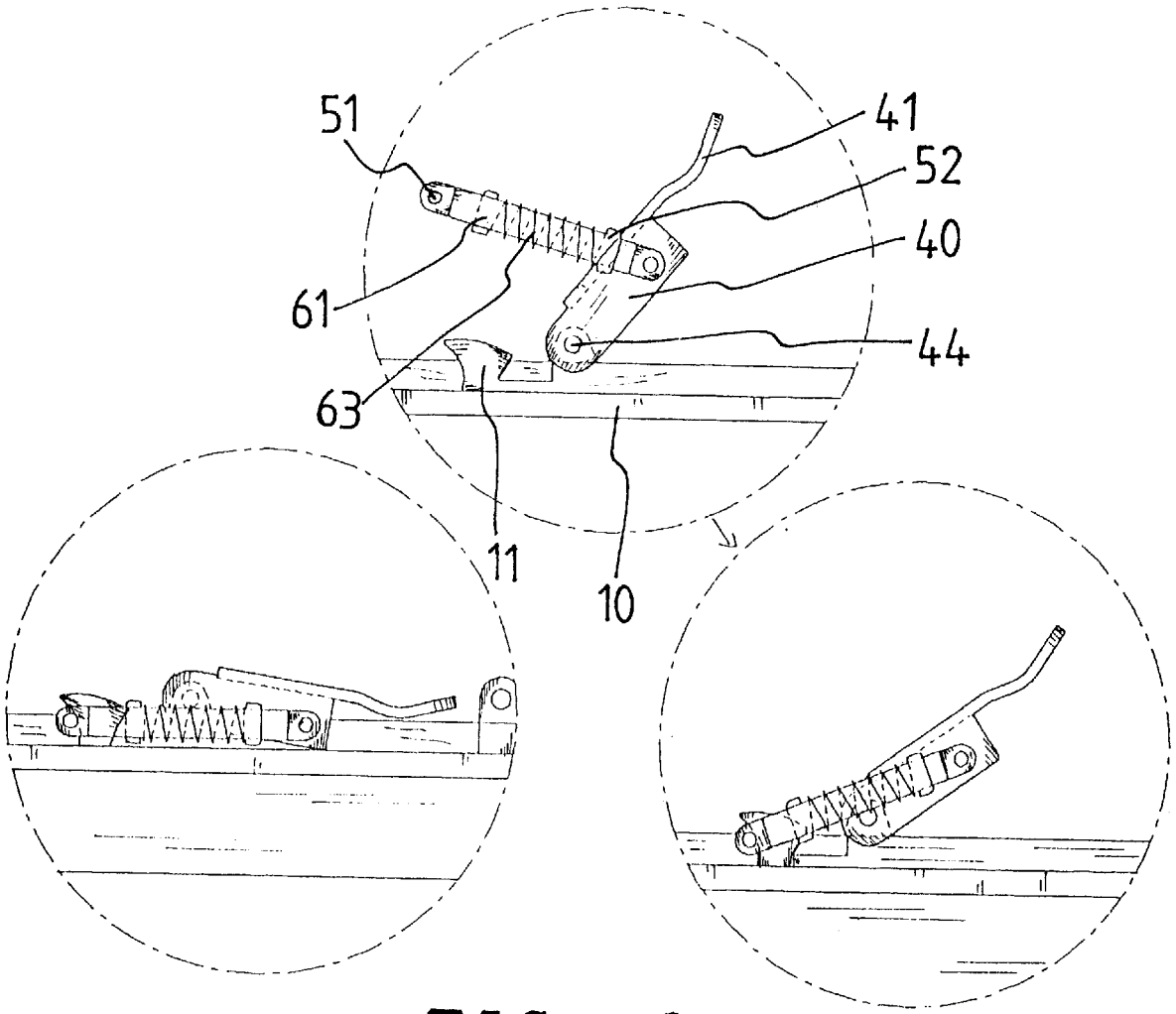
FIG. 3 is an illustrative view to show the steps to engage the locking frame with the two hooks on the front end board of the power stapler.

Referring to FIGS. 1 to 3, the secure device in accordance with the present invention comprises a top cover 30 which is located on a top of a front end board 11 of a power stapler 10 wherein a plurality of grooves 111 are defined in a top of the front end board 11 so that staples (not shown) are received in the grooves 111. The frond end board 11 has two hooks 110 extending from two sides thereof and two lugs 33 extend from tow sides of the front end board 11. Each lug 33 has a hole 331 defined therethrough. The top cover 30 is located between the two hooks 110. The top cover 30 has a front end and rear end which contacts a transverse board 20 which is fixedly connected to the front end board 11 adjacent to a body of the power stapler 10 by bolts 22 through two end holes 21 in the transverse board 20 and engaged with the two threaded holes 12 in the front end board 11. Two threaded holes 12 defined through the front end board 11 and located beside the body of the power stapler 10.

A U-shaped locking frame 50 has a locking rod 51 and two side arms 52 extend from two ends of the locking frame 50. The locking rod 51 are disengagably engaged with the two hooks 110 and each side arm 52 has a first protrusion 520 extending laterally from a distal end thereof. Two plates 60 each have a first end and second end, each plate 60 has a second protrusion 61 extending laterally from the first end of the plate 60. The two plates 60 are respectively overlapped to the two side arms 52, and two springs 63 are respectively mounted to the arm 52 and the plate 60 overlapped with each other. The spring 63 is retained between the firs protrusion 520 and the second protrusion 61.

A pivotal member 40 has two sidewalls and a lever 41. Each sidewall has a first hole 42 and a second hole 43 defined therethrough. A first pin 44 extends through the first holes 42 in the two sidewalls of the pivotal member 40 and the holes 331 in the two lugs 33 on the top cover 30. A second pin 45 extends through the second holes 43 in the two sidewalls of the pivotal member 40 and a hole 62 defined in the second end of each plate 60.

When the user wants to open or to install the top cover 30, he/she lifts or pushes the lever 41, and the springs 63 make the movement of the lever 41 more easier. In other words, when lifting the lever 42, the springs 63 provide an upward component force right after the lever 42 is lifted, the springs 63 provide an horizontal force to secure the locking rod 51 with the two hooks 110 when the lever 42 is completely pushed.

Figure 4:
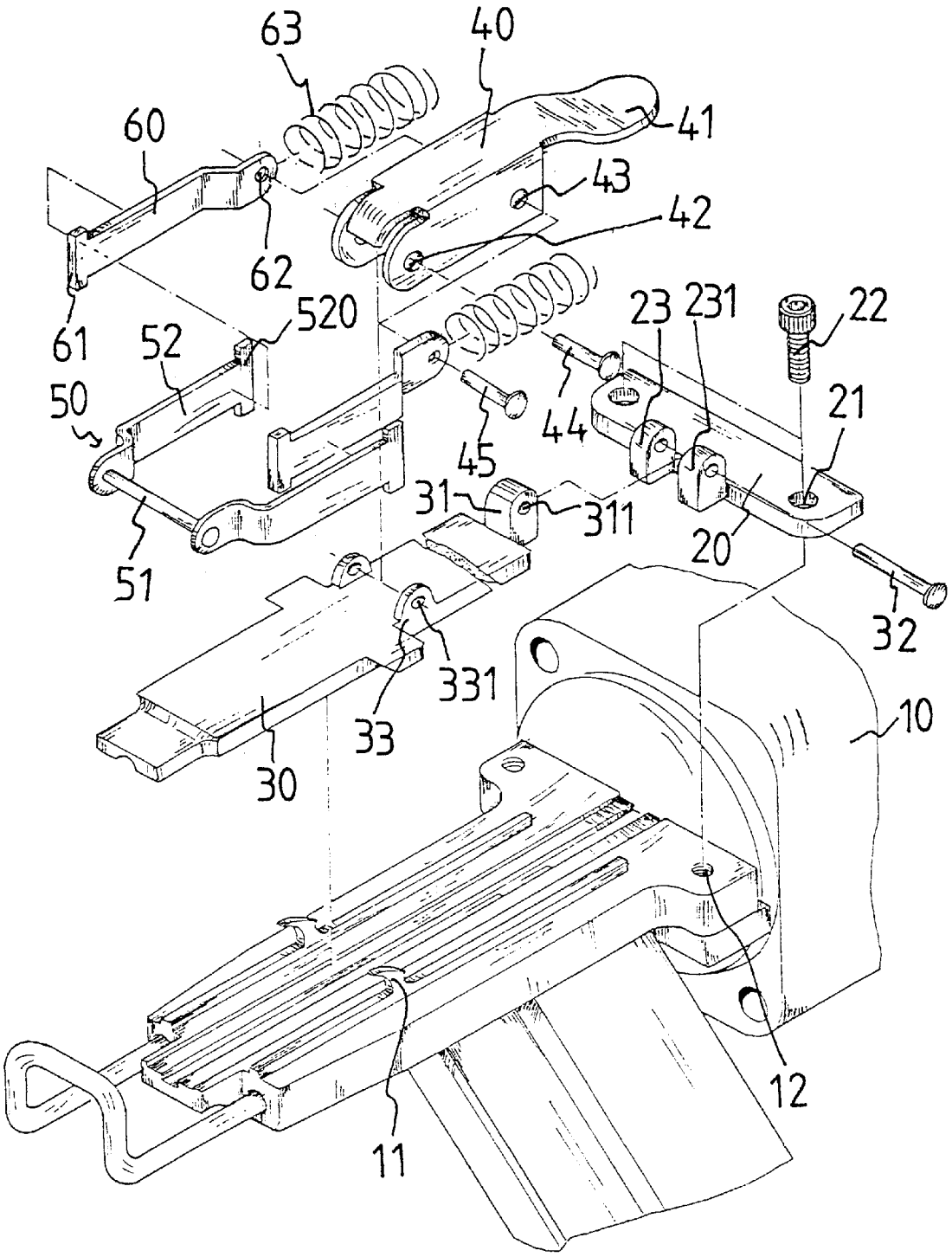
FIG. 4 is an exploded view to show another embodiment of the secure device for securing a top cover on a power stapler of the present invention.
Figure 5:
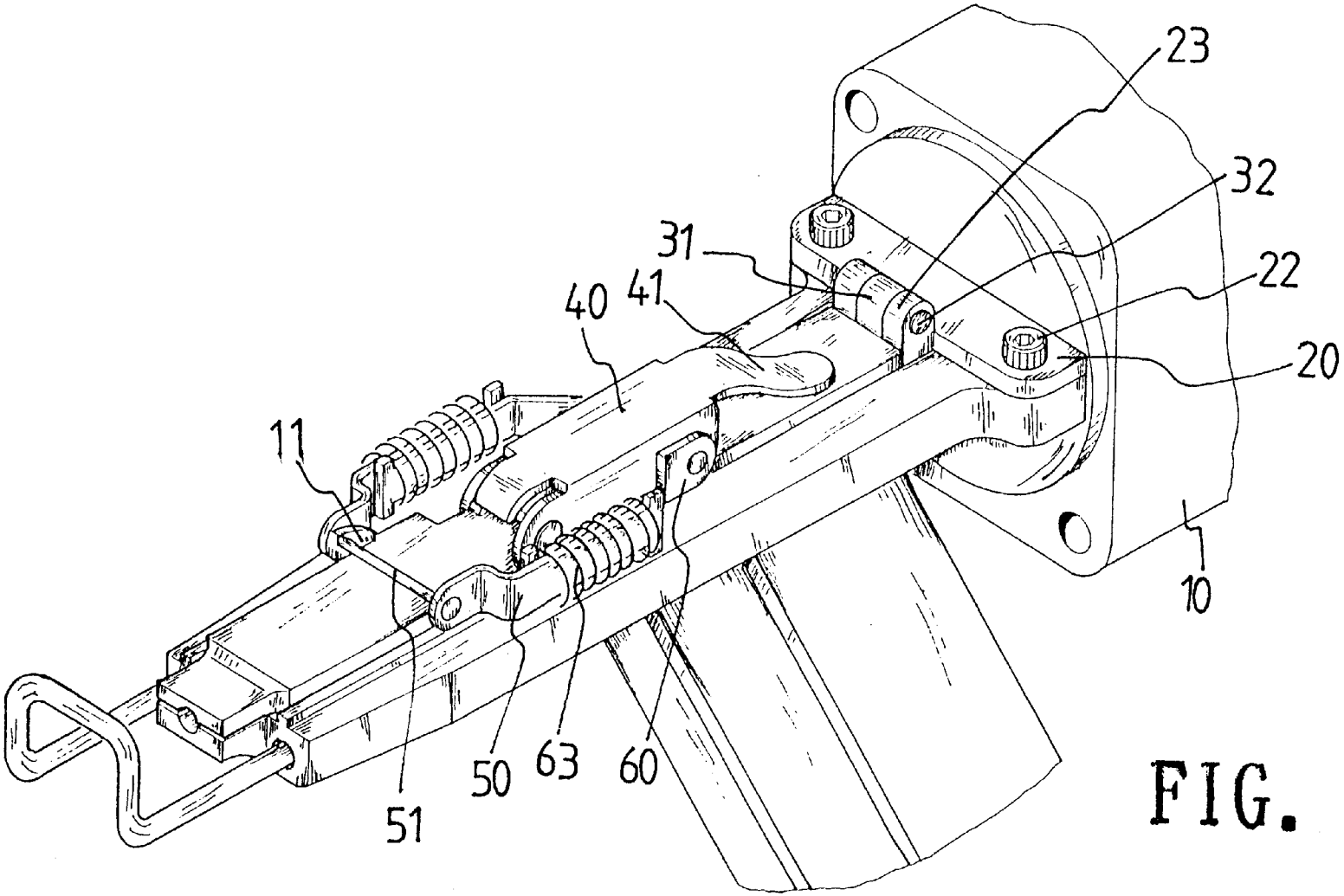
FIG. 5 is a perspective view to show the secure device as shown in FIG. 4 on the power stapler of the present invention.

FIGS. 4 and 5 show another embodiment of the engagement between the transverse board 20 and the top cover 30, wherein the top cover 30 has an ear 31 on the rear end thereof and a hole 311 is defined through the ear 31. The transverse plate 20 has two lugs 23 to define a recess between the two lugs 23. A pin 32 extends through two holes 231 in the two lugs 23 and the hole 311 in the recess so that the top cover 30 can be pivoted about the pin 32.

Wile we have shown and described various embodiments in accordance with the present invention, it should be clear to those skilled in the art that further embodiments may be made without departing from the scope and spirit of the present invention.

What is claimed is:

1. A secure device for securing a top cover on a power stapler which has a front end board with a plurality of grooves defined in a top of the front end board, the front end board having two hooks extending from two sides of the top thereof, the secure device comprising:

a top cover adapted to be located on said top of the front end board and two lugs extending from two sides of said top cover, said top cover adapted to be located between the two hooks, said top cover having a front end and rear end;

a locking frame having a locking rod and two side arms extending from two ends of said locking frame, said locking rod adapted to be disengagably engaged with said two hooks, two plates each having a first end and second end, said two plates respectively overlapped to said two side arms, two springs respectively mounted to said arm and said plate overlapped with each other, and a pivotal member having two sidewalls and each sidewall having a first hole and a second hole defined therethrough, a first pin extending through said first holes in said two sidewalls of said pivotal member and said two lugs on said top cover, a second pin extending through said second holes in said two sidewalls of said pivotal member and said second end of each plate.

2. The secure device as claimed in claim 1, wherein each plate has a first protrusion extending laterally from said first end of said plate, each side arm having a second protrusion extending laterally from a distal end thereof.

3. The secure device as claimed in claim 1 further comprising a lever extending from said pivotal member.

4. The secure device as claimed in claim 1 further comprising a transverse plate connected to said rear end of said top cover and adapted to be fixedly connected to said front end board.

5. The secure device as claimed in claim 4, wherein said top cover has an ear on said rear end thereof and said transverse plate has a recess defined therein so that said ear is engaged with said recess.

* * * * *